United States Patent [19]

Sweeney

[11] 4,190,118

[45] Feb. 26, 1980

[54] DRIVE CAP

[75] Inventor: Lawrence J. Sweeney, Seneca, Pa.

[73] Assignee: Franklin Steel Company, Franklin, Pa.

[21] Appl. No.: 916,856

[22] Filed: Jun. 19, 1978

[51] Int. Cl.[2] ..... B25D 9/00

[52] U.S. Cl. ..... 173/130; 403/4

[58] Field of Search ..... 173/128, 129, 130; 405/255; 403/4, 3

[56] References Cited

U.S. PATENT DOCUMENTS

| | | | |
|---|---|---|---|
| Re. 15,669 | 8/1933 | Hindmarsh | 173/130 |
| 1,875,687 | 9/1932 | Willwerscheid et al. | 173/130 |
| 2,214,295 | 9/1940 | De Biasi | 173/130 |
| 2,931,186 | 4/1960 | Frederick | 173/130 |
| 3,454,113 | 7/1969 | Holtz | 173/129 |

*Primary Examiner*—Lawrence J. Staab

*Attorney, Agent, or Firm*—Fitch, Even & Tabin

[57] ABSTRACT

A drive cap is disclosed for use in driving structural posts of the type which may be employed in roadside sign post structures wherein the posts have lateral generally coplanar flanges interconnected by an offset web, and wherein the posts may have different major and minor transverse axis dimensions. The drive cap comprises a drive block having a recess therein adapted to receive either of several different size structural posts in closely fitting relation therewith so as to facilitate driving of the posts longitudinally into the ground, the drive cap being adapted for cooperation with an impact type power tool for use in driving the posts into the ground.

6 Claims, 4 Drawing Figures

Fig. 1.
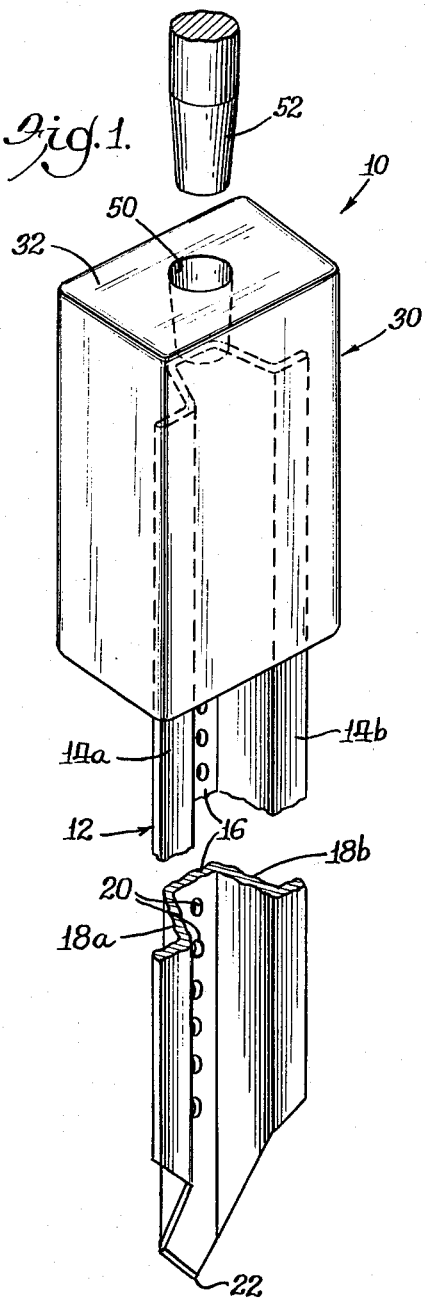
Fig. 2.
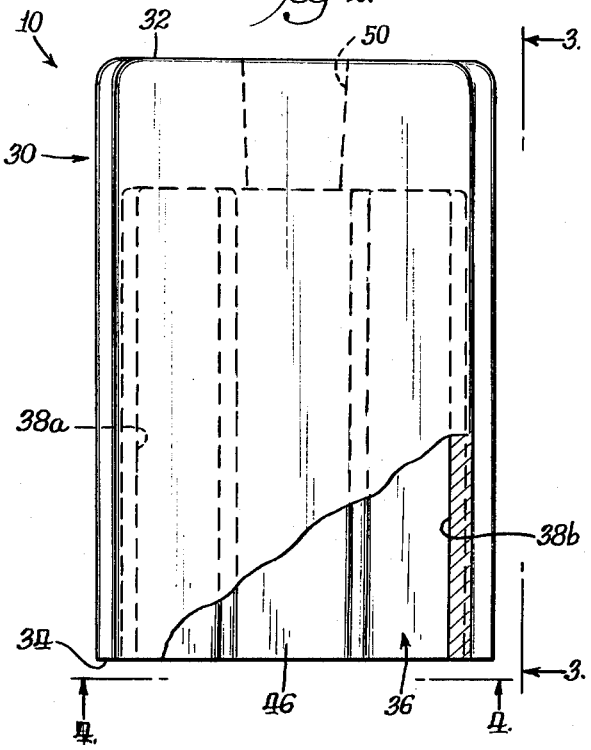
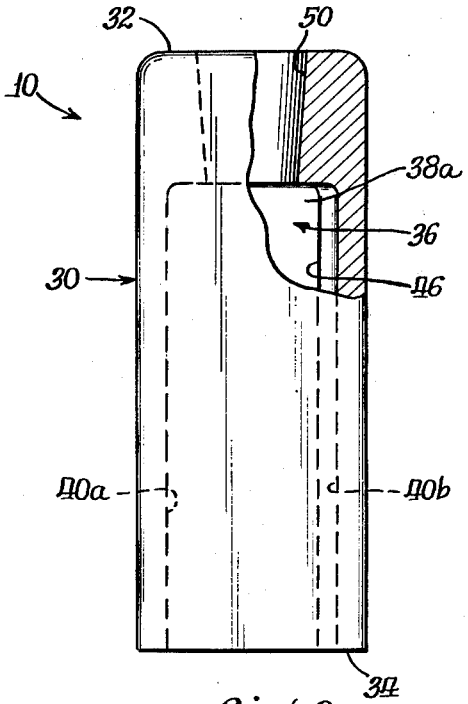
Fig. 3.
Fig. 4.
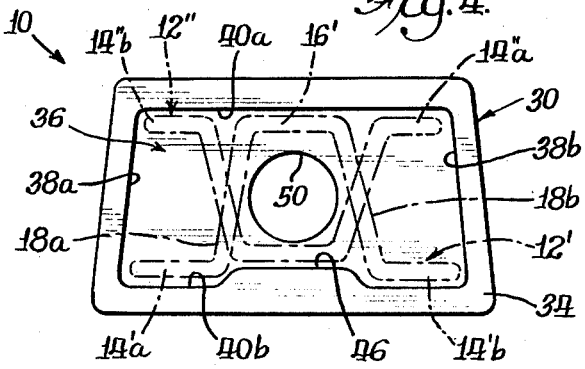

DRIVE CAP

The present invention relates generally to devices for use in driving structural posts and the like longitudinally into the ground, and more particularly to a novel drive cap particularly adapted for use with structural posts of the type having generally coplanar lateral flanges interconnected through an offset web, the drive cap being adapted for use with such structural posts of different transverse size while maintaining close interfitting relation therewith during operation.

It is a conventional practice in supporting signs such as employed adjacent highways and streets to utilize channel type posts manufactured from high strength steel and the like. The posts may comprise single piece posts which are driven longitudinally into the ground whereafter a sign is suitably secured to the post at a desired elevation. An improved technique for mounting such road signs, and one which has proven particularly satisfactory from a safety standpoint, employs a base post which is driven longitudinally into the ground while leaving an exposed portion above the ground surface to which an upper post section is secured, the sign then being secured to the upper end of the upper post at a desired elevation. Preferably, the lower end of the upper post is secured to the upper exposed end of the lower base post through safety release means which facilitate release of the upper post section when subjected to a predetermined impact force as from a misdirected vehicle or the like.

In either of the aforedescribed sign post constructions, either the single piece sign post or the base post portion of the composite sign post must be driven into the ground. One technique for accomplishing this is to mount a drive block over the upper end of the support post and impact the drive block by relatively heavy hammers so as to drive the post into the ground to a desired depth. In sign post constructions of the type wherein the posts are made from high strength steel formed with generally coplanar lateral flanges interconnected by a generally U-shaped or offset web, frequently termed "channel" type posts, the posts may have different sizes with correspondingly different strength characteristics dependent upon their intended usage. Where high strength and heavy duty requirements must be met, a channeled sign post having greater lateral width and transverse depth may be employed than would be required for a lighter duty application. For driving different size channel posts into the ground, it is desirable that a common drive cap be capable of use with both large and small size posts, thus eliminating the need for two separate drive caps with attendant reduction in costs. In the design of a drive cap capable of use with different size channel posts, it is also desirable that the drive cap be capable of close interfitting relation with both size posts when mounted thereon so as to prevent wobbling of the drive cap during impacting to drive the posts longitudinally into the ground. This is particularly desirable when employing reciprocating type power drive tools.

One of the primary objects of the present invention is to provide a novel drive cap for use in driving structural posts longitudinally into the ground, which drive cap may be employed with different size posts.

A more particular object of the present invention is to provide a novel drive cap for use in driving structural posts longitudinally into the ground, the posts being of the type having generally coplanar lateral flanges interconnected through a generally U-shaped web, and the drive cap comprising a drive block defining a recess therein adapted to receive different size posts in closely fitting relation therewith to facilitate driving of the posts longitudinally into the ground.

A feature of the drive cap in accordance with the present invention lies in the provision of a recess in the drive block which permits mounting of the drive cap on the ends of different size channel type posts and wherein the recess has a predetermined depth facilitating use of the drive cap as a depth gauge to obtain a predetermined exposed length of post after driving the post longitudinally into the ground.

Another feature of the drive cap in accordance with the present invention lies in the provision of a recess in the end of the drive block opposite the post receiving recess for cooperation with an impact type power tool as may be employed to drive an associated post.

Further objects and advantages of the present invention, together with the organization and manner of operation thereof, will become apparent from the following detailed description of the invention when taken in conjunction with the accompanying drawing wherein like reference numerals designate like elements throughout the several views and wherein:

FIG. 1 is a fragmentary perspective view illustrating a drive cap constructed in accordance with the present invention operatively mounted on a channel type post in a manner to facilitate driving of the post longitudinally into the ground;

FIG. 2 is an elevational view of the drive cap of FIG. 1, portions being broken away for clarity;

FIG. 3 is a side elevational view of the drive cap of FIG. 2, taken substantially along line 3—3 of FIG. 2; and FIG. 4 is a bottom view of the drive cap of FIG. 1, taken along the line 4—4 of FIG. 2, looking in the direction of the arrows and showing in phantom two different size posts with which the drive cap may be employed.

Referring now to the drawing, and in particular to FIG. 1, a drive cap constructed in accordance with the present invention is indicated generally at 10. The drive cap 10 is particularly adapted for use in driving channel type structural posts, one of which is fragmentarily shown at 12, longitudinally into the ground. The posts with which the drive cap 10 is employed are of the type conventionally made from high strength metallic material, such as high strength hot rolled steel, and have a pair of substantially coplanar lateral flanges **14*a* and 14*b* integrally interconnected through a generally U-shaped web having a substantially planar rear wall 16 and forwardly diverging side walls 18*a* and 18*b* the forward longitudinal edges of which terminate in the laterally outwardly directed coplanar flanges 14*a, b*. Posts of the type illustrated at 12 are conventionally employed as roadside sign posts and, to this end, conventionally have a plurality of equidistantly spaced openings 20 formed through and along the longitudinal center of the offset rear wall 16** to facilitate connection of a sign to the post at a selected position along the length of the post when disposed in upstanding relation.

As aforementioned, it is conventional to drive such structural posts 12 longitudinally into the ground or a like supporting foundation, with the post having an overall longitudinal length so that a sign may be attached directly to the upper end of the post at a desired height. Alternatively, the sign post may comprise a composite post construction having a base post section which is first driven into the ground and to which an upper post section is attached, as through safety impact release means (not shown) of the type disclosed in U.S. patent application, Ser. No. 808,794, filed June 22, 1977. The sign may then be attached at a desired height to the upwardly extending upper post section. To facilitate driving of the post 12 into the ground, its lower end is preferably pointed as at 22.

In driving the post 12 into the ground, it is desirable that the drive cap be mounted over the upper end of the sign post so that impacting of the post to drive it into the ground may be effected without damaging or deforming the post. The transverse dimensional size of the channel type structural posts may vary depending upon the particular application for which the channel type structural posts are to be employed. More particularly, while the basic transverse cross-sectional configurations of the different size posts are generally similar, the dimension between the outer longitudinal edges of the coplanar flanges 14*a, b* of the posts, which dimension constitutes the major transverse dimension of the post cross-section, and the dimension between the plane of the forwardly facing surfaces of the flanges 14*a, b* and the rearwardly facing surface of the rear wall 16, which dimension constitutes the minor transverse dimension of the post cross section, may vary between post sizes. For example, as between two post sizes, a first size post might have greater major and minor transverse dimensions, respectively, than the major and minor transverse dimensions of a second smaller size post otherwise having a generally similar transverse cross-sectional configuration. In accordance with the present invention, the drive cap 10 is adapted for use with such different size posts and is adapted to be mounted on the upper end of different size post sections in relatively close interfitting relation therewith so as not to wobble when impacted by an external force sufficient to drive the associated structural post longitudinally into the ground.

With particular reference to FIGS. 2–4, taken in conjunction with FIG. 1, the drive cap 10 includes a drive block or body member, indicated generally at 30, having a generally rectangular outer configuration and made of a suitable strength material, such as a high strength metallic material, adapted to withstand external impact forces during usage, as will become more apparent hereinbelow. The drive block 30 has upper and lower generally parallel planar surfaces 32 and 34, respectively. A recess or chamber 36 is formed in the drive block 30 so as to intersect the lower end surface 34 thereof with the axis of the recess coinciding with the longitudinal axis of the body member. The recess 36 is substantially uniform in transverse cross section throughout its full length and defines a trapezoidal cross section having a pair of mutually facing non-parallel lateral side surfaces 38*a* and 38*b* and a pair of mutually facing substantially parallel surfaces 40*a* and 40*b*, as best seen in FIG. 4.

In accordance with the present invention, the recess 36 is configured so as to receive therein in relatively close interfitting relation an end of a channel type post of a first post size, indicated in phantom in FIG. 4 at 12', when the drive cap is oriented so that the lateral flanges 14'*a* and 14'*b* of the post 12' are disposed in close facing or contacting relation with the internal recess surface 40*b* and with the outer surface of the rear wall 16' closely proximate or contacting the surface 40*a* of the recess 36. While disposed in this orientation to receive the larger size post 12', it will be appreciated that a smaller size but similarly configured structural post, such as illustrated in phantom in FIG. 4 at 12'', could also be received within the recess 36 when the smaller size post is oriented similar to post 12' but the smaller post would not have relatively close interfitting relation with the drive cap 10. In the latter instance, undesirable wobbling of the drive cap on the end of the structural post could take place.

When, however, the smaller size post 12'' is disposed in a position as shown in phantom in FIG. 4, the drive cap may be inserted over the end of the smaller size post so that the shorter width recess surface 40*a* is disposed in opposed or contacting relation with the outer surfaces of the coplanar flanges 14''*a* and 14''*b*. In the orientation of the drive cap 10 relative to the smaller size structural post 12'' shown in phantom in FIG. 4, the drive cap is adapted to prevent insertion of a larger size post 12' when disposed in similar orientation to the drive cap as is the smaller size post. To this end, the surface 40*b* of the recess 36 has a generally centrally located projection 46 formed thereon which extends slightly toward the center of the recess 36 so as to establish a surface dimension between the inner surface of the projection 46 and the opposed planar surface 40*a* of the recess which is less than the dimension between the outer surface of the rear wall 16' and the forward surfaces of the coplanar flanges 14'*a* and 14'*b* of the larger size post section 12'.

When mounted on either the larger or smaller size posts, the recess 36 has a predetermined longitudinal depth, such as 5 inches, so that when employed to drive a structural post into the ground, the post may be driven in until the lower surface 34 of the drive cap abuts the ground surface at which time a predetermined length of the post section will be exposed above ground level for purposes of mounting an upper post section thereto in the case of a composite post construction.

With the drive cap 30 mounted on the upper end of a structural post in axial alignment therewith preparatory to driving the post longitudinally into the ground, impacting of the drive cap and thereby the associated structural post may be effected by impacting the upper surface 32 of the drive cap with a relatively heavy hammer. Preferably, a frustoconical bore 50 is formed in the drive block 30 so as to intersect the upper surface 32, with the axis of the bore 50 coinciding with the axis of the recess 36. The bore 50 is of a size suitable to receive the lower tapered end 52 of an impact type reciprocating power tool (not shown) of known design.

Thus, in accordance with the present invention, a drive cap is provided which permits its use with channel type structural posts of different size while maintaining relatively close interfitting relation with an end of a particular size post when the drive cap is mounted thereon so as to substantially prevent relative wobbling movement between the drive cap and the associated post. By facilitating use of the drive cap with channel type structural posts of different sizes, the need for a separate drive cap for each different size post is eliminated, resulting in attendant economic savings and efficiency.

While a preferred embodiment of the present invention has been illustrated and described, it will be understood to those skilled in the art that changes and modifications may be made therein without departing from the invention in its broader aspects.

Various features of the invention are defined in the following claims.

What is claimed is:

1. A drive cap for use in driving structural posts longitudinally into the ground, the posts being of the type having a pair of substantially coplanar lateral flanges interconnected through a web having a wall which is substantially parallel to and offset from the plane of said lateral flanges, said lateral flanges having outer longitudinal edges spaced to define the major transverse dimension of the post, and the plane of said lateral flanges being spaced from the plane of said wall to define the minor transverse dimension of the post, said drive cap being adapted for use with posts of different transverse size wherein a first size post has major and minor transverse dimensions greater, respectively, than the major and minor transverse dimensions of a second size post, said drive cap comprising a drive block having a longitudinal axis and upper and lower ends and defining a recess therein intersecting one of said ends, said recess being defined by nonparallel laterally spaced side walls and mutually facing front and rear walls interconnected to said side walls so that said recess is adapted to receive an end of a post of said first post size therein with said cap in generally closely fitting relation with the outer longitudinal edges of said lateral flanges when said cap is disposed in a first predetermined orientation relative to said first size post and so as to receive an end of a post of said second post size therein with said cap in generally closely fitting relation with the outer longitudinal edges of the lateral flanges of said second size post when said cap is disposed in a second predetermined orientation relative to said second size post rotated substantially one-half revolution about its longitudinal axis from said first predetermined orientation relative to said first size post, the other end of said drive cap facilitating impacting of said cap by an external force to drive said first or second size posts into the ground when said cap is mounted thereon.

2. A drive cap as defined in claim 1 wherein said walls are spaced apart so as to prevent receipt therein of a post of said first post size when said cap is rotated substantially 180 degrees about its longitudinal axis from said first predetermined orientation relative to said first post size.

3. A drive cap for use in driving structural posts longitudinally into the ground, the posts being of the type having a pair of substantially coplanar lateral flanges interconnected through a web having a wall which is substantially parrallel to and offset from the plane of said lateral flanges, said lateral flanges having outer longitudinal edges spaced to define the major transverse dimension of the post, and the plane of said lateral flanges being spaced from the plane of said wall to define the minor transverse dimension of the post, said drive cap being adapted for use with posts of different transverse size wherein a first size post has major and minor transverse dimensions greater, respectively, than the major and minor transverse dimensions of a second size post, said drive cap comprising a drive block having a longitudinal axis and upper and lower ends and defining a recess therein intersecting one of said ends, said recess having a substantially trapezoidal transverse cross sectional configuration adapted to receive an end of a post of said first post size therein in closely fitting relation with said cap when said cap is disposed in a first predetermined orientation relative to said first size post, said recess having nonparallel lateral side surfaces and being further adapted to receive an end of a post of said second post size therein in closely fitting relation with said cap when said cap is disposed in a second predetermined orientation relative to said second post while preventing entry into said recess of a post of said first post size when said cap is rotated substantially one-half revolution about its longitudinal axis from said first predetermined orientation relative to said first size post, the other end of said drive cap facilitating impacting of said cap by an external force to drive said first or second size posts into the ground when said cap is mounted thereon.

4. A drive cap as defined in claim 3 wherein said generally trapezoidal recess has two substantially parallel wall surfaces of different lateral width, the wider of said two parallel wall surfaces having a portion thereof extending inwardly into said recess to define a contact surface adapted to engage the web of a post of said second size when received within said recess.

5. A drive cap as defined in claim 1 wherein said recess extends longitudinally of said drive block and has a predetermined depth so as to effect exposure of a corresponding predetermined length of a post above ground level when the post is driven into the ground by impacting said drive cap until the drive cap engages the ground.

6. A drive cap as defined in any one of claims 1, 4 or 5 wherein said drive block has a tool receiving recess formed in the end thereof opposite said post receiving recess, said tool receiving recess being adapted for cooperation with a reciprocating type power drive tool.

* * * * *